US007025145B2

(12) United States Patent
Emmerson

(10) Patent No.: US 7,025,145 B2
(45) Date of Patent: Apr. 11, 2006

(54) TENSIONING ARRANGEMENT FOR A SUBSEA WELLHEAD ASSEMBLY

(75) Inventor: Robert Emmerson, Ellon (GB)

(73) Assignee: Aker Kvaerner Subsea Limited, Berkshire (GB)

( * ) Notice: Subject to any disclaimer, the term of this patent is extended or adjusted under 35 U.S.C. 154(b) by 0 days.

(21) Appl. No.: 10/482,276

(22) PCT Filed: Jun. 28, 2002

(86) PCT No.: PCT/GB02/02992

§ 371 (c)(1),
(2), (4) Date: Dec. 29, 2003

(87) PCT Pub. No.: WO03/002845

PCT Pub. Date: Jan. 9, 2003

(65) Prior Publication Data

US 2004/0168810 A1 Sep. 2, 2004

(30) Foreign Application Priority Data

Jun. 28, 2001 (GB) ..... 0115859

(51) Int. Cl.
*E21B 29/12* (2006.01)
*F16L 17/00* (2006.01)

(52) U.S. Cl. ..... 166/348; 166/208; 166/212; 285/123.4

(58) Field of Classification Search ..... 166/348, 166/382, 378, 367, 368, 75.14, 381, 208, 166/212, 344, 89.1; 285/18, 123.4, 86, 123.3, 285/123.1, 900, 920
See application file for complete search history.

(56) References Cited

U.S. PATENT DOCUMENTS

| | | | | |
|---|---|---|---|---|
| 3,222,088 | A * | 12/1965 | Haeber | 285/18 |
| 3,321,217 | A * | 5/1967 | Ahlstone | 285/18 |
| 3,520,361 | A * | 7/1970 | Lewis | 166/134 |
| 4,441,741 | A | 4/1984 | Galle, Jr. | |
| 4,489,964 | A * | 12/1984 | Kipp et al. | 285/374 |
| 4,496,172 | A * | 1/1985 | Walker | 285/18 |
| 4,515,213 | A * | 5/1985 | Rogen et al. | 166/123 |
| 4,526,406 | A * | 7/1985 | Nelson | 285/18 |
| 4,697,828 | A | 10/1987 | Chou | |
| 5,199,497 | A | 4/1993 | Ross | |
| 6,234,252 | B1 * | 5/2001 | Pallini et al. | 166/345 |
| 6,260,624 | B1 * | 7/2001 | Pallini et al. | 166/345 |
| 6,516,887 | B1 * | 2/2003 | Nguyen et al. | 166/348 |
| 6,540,024 | B1 * | 4/2003 | Pallini et al. | 166/348 |
| 2002/0100596 | A1 | 8/2002 | Nguyen et al. | |

FOREIGN PATENT DOCUMENTS

EP 0 448 871 A 10/1991

* cited by examiner

*Primary Examiner*—Thomas A Beach
(74) *Attorney, Agent, or Firm*—Nixon & Vanderhye P.C.

(57) ABSTRACT

A pre-tensioning arrangement for inner and outer elongate concentric members includes a load member which is axially movable in an actuating direction relative to the inner member and has an outer surface which tapers in the actuating direction, a laterally expansible ring which is engaged by the load member in an inclined engagement zone during the actuating movement, and an engagement zone between the laterally expansible ring and the outer member, the engagement zones providing a mechanical advantage between the movement of the load member and movement of the outer member.

7 Claims, 2 Drawing Sheets

TENSIONING ARRANGEMENT FOR A SUBSEA WELLHEAD ASSEMBLY

The invention relates to an arrangement to apply tension to the outer of two concentric sleeves or other elongate members.

In particular the invention relates to a mechanical arrangement forming part of a subsea wellhead assembly to apply tension to an outer conductor housing surrounding an inner conductor.

BACKGROUND TO THE INVENTION

The development of subsea oil and/or gas fields in deepwater has led to problems not met with onshore fields. One such problem is the fatigue damage experienced by the smaller inner conductors due to bending loads applied at the wellhead interface.

Fatigue damage can be reduced if the bending loads are transmitted by way of pretension directly into the conductor housing and outer conductor. To be effective, a significant pre-tension load must be developed in the conductor housing.

SUMMARY OF THE INVENTION

The invention broadly provides a pre-tensioning arrangement for inner and outer elongate concentric members, comprising a load member which is axially movable in an actuating direction relative to the inner member and has an outer surface which tapers in said actuating direction, a laterally expansible means which is engaged by said load member in an inclined engagement zone during said actuating movement, and an engagement zone between the laterally expansible means and the outer member, said engagement zones providing a mechanical advantage between the movement of the load member and movement of the outer member.

The load member may be a ring around the inner member and the laterally expansible means may be a split or segmented ring.

The laterally expansible means may be disposed in a holder which provides an inclined path of movement for the laterally expansible means whereby outward movement of the laterally expansible means has a component in the said actuating direction. The laterally expansible means may carry teeth for engagement in grooves in the outer member and the engagement zone between the laterally expansible means and the outer member may have a shallow inclination relative to an outward direction of movement of the laterally expansible means.

A latch may be disposed to hold the load member at an extreme limit of the actuating movement.

A specific embodiment of the invention will now be described by way of example with reference to the accompanying drawings.

DESCRIPTION OF AN EXEMPLARY EMBODIMENT

Figures 1, 2:
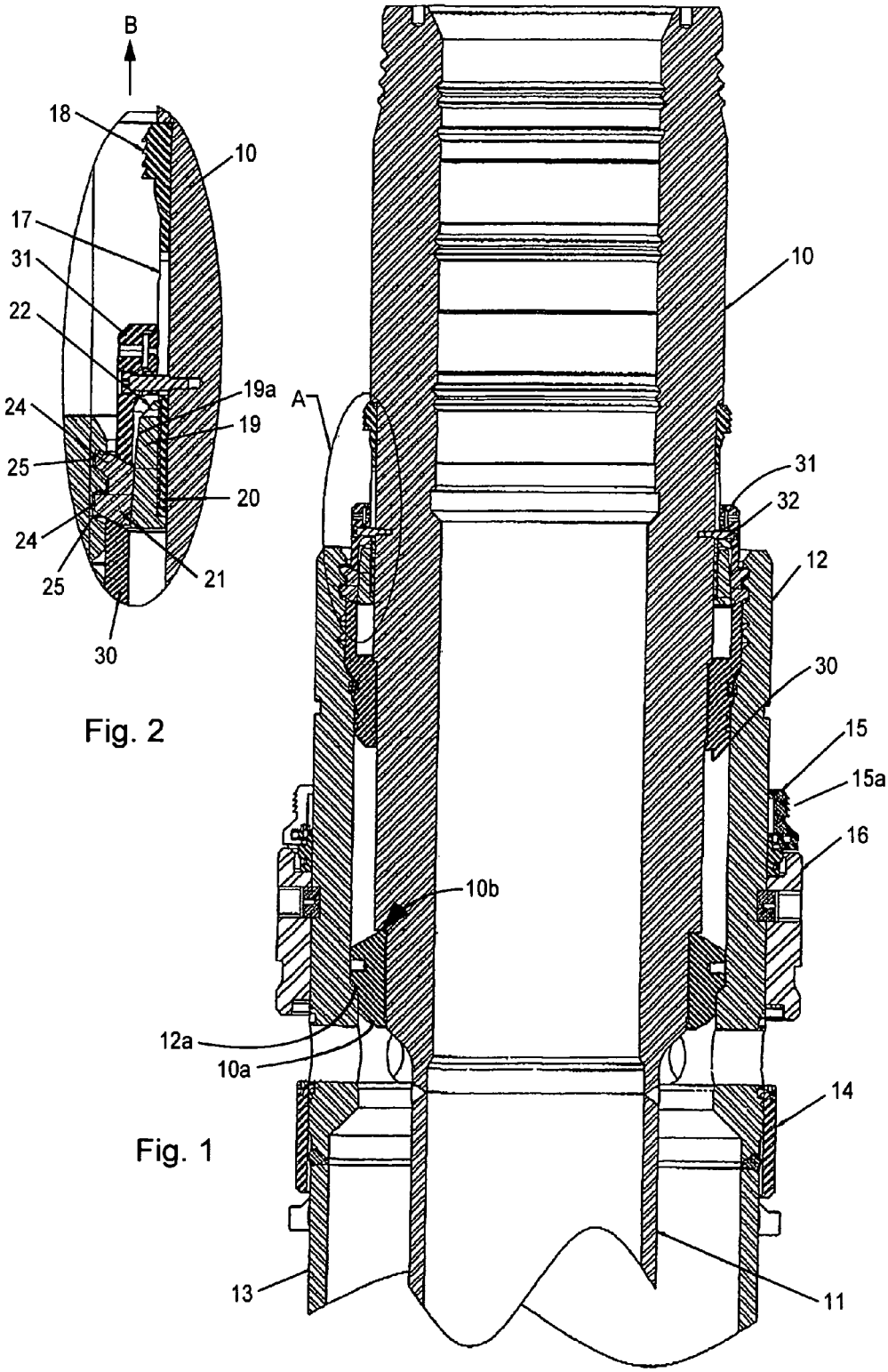
FIG. 1 is a vertical cross section on the axis of a wellhead showing a tensioning arrangement in an activated configuration.
FIG. 2 is an enlarged cross section of a region denoted "A" in FIG. 1.

FIG. 1 shows a wellhead 10 in its normal state in use, extending vertically upwards from a subsea hydrocarbon deposit. The wellhead has the basic form of a cylindrical pipe. At the foot of the wellhead 10 and consisting a downward extension of it there is an (inner) conductor 11 which is likewise in the form of a cylindrical pipe and penetrates down into the seabed strata towards the subsea hydrocarbon deposit. At the seabed level of the wellhead an outer conductor constitutes a housing 12 which surrounds the wellhead 10 and has a downward extension 13 to define an annular space with the inner conductor 11.

In this example the wellhead 10 and the housing 12 are the inner and outer elongate concentric members which are to be relatively pre-tensioned.

On the outside of the housing 12 are some components which are not directly relevant to the invention and which are in generally known form. It is customary to provide a cement lining for the well in the space between members 11 and 13. In order to close off access holes for this space there is an annular shut-off sleeve 14 which can be shifted axially by a shut-off activation mechanism 15. This can be activated by means of a pull-ring which threadingly engages a screw threading 15*a*. Surrounding the conductor housing 12 (and disposed to allow the shifting of the shut-off sleeve) is an attachment sleeve 16 which serves to secure the wellhead to a wellhead base or the like disposed on the seabed.

As previously noted the main purpose of the invention is to provide a pre-tension between the outer member (housing) 12 and the inner member constituted by the wellhead 10. For this purpose the outer member is pulled upwardly by the mechanism denoted A in FIG. 1 and more particularly described with reference to FIGS. 2 to 5. Reaction to the pulling on the outer conductor is provided by a steel reaction ring 10*a* which engages an annular shoulder 10*b* around the outside of the wellhead in the vicinity of the bottom of the wellhead. The reaction ring engages an annular shoulder 12*a* on the inside of the outer conductor housing 12. This shoulder 12*a* is preferably inclined so that the reaction force on the outer conductor 12 is directed obliquely outwards.

The tensioning arrangement A in this embodiment requires an external (pull-up) force which is applied to an actuating member constituted by an actuating sleeve 17 (FIG. 2) disposed on the wellhead 10 and axially slideable relative to the wellhead 10. The actuating sleeve has at its upper end a screw threading 18 which can be engaged by a threaded pull-up ring (not shown) and can thereby be forced upwardly in the direction of arrow B. At the lower end of the sleeve 17 is a tapered load member comprising a load ring 19 which threadingly engages the lower outer margin 20 of the actuating sleeve 17.

The load ring 19 has a tapered outer surface 19*a*, the sense of the taper of the surface being in the direction of tensioning. The angle of the taper may be narrow, preferably less than 15° and in this embodiment approximately 4°. At its upper edge 22 the conical surface is chamfered (see FIG. 4).

The outer surface of the load ring 19 is in contact with a laterally expansible ring 21 which is moved into engagement with the housing 12. The ring 21 may be a split or segmented ring.

The ring 21 is held in a holder comprising a lower sleeve 30, which is threaded on the wellhead 10, and an upper sleeve 31, which is secured by bolts 32 to the wellhead 10. The actuating sleeve 17 is slotted to accommodate the passage of the bolts 32.

The upper and lower surfaces 21*a* and 22*a* are inclined upwardly, at a shallow angle such as 30° to the horizontal (i.e. preferably less than 45°) and the confronting end surfaces of the sleeves 30 and 31 are correspondingly inclined so that the split ring can move in an outward and upward inclined path as the load ring 19 is pulled upwards in engagement with the ring 21.

The lower inner edge of the ring 21 is chamfered (23), to ease the engagement of the ring 21 by the load ring 19.

The outer surface of the ring 21 has upper and lower teeth 24 which are engagable with inwardly facing grooves 25 on the inner side of the housing 12. The upper surfaces of these grooves may have a very shallow inclination, either positive or negative, but preferably an outward and upward inclination of, for example 5°, the upper surfaces of the teeth being correspondingly inclined, so that there will be an inward component of the force applied to the housing by the teeth. Two sets of teeth are provided to lessen the load on an individual tooth.

Figure 3:
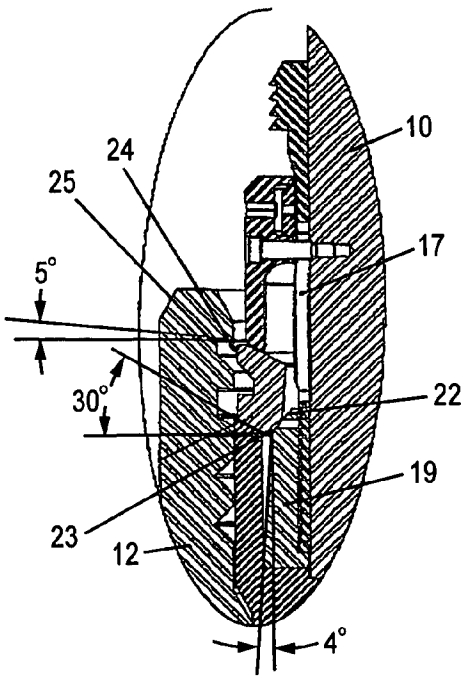
FIG. 3 is a diagram showing the position of components before actuation.
Figure 4:
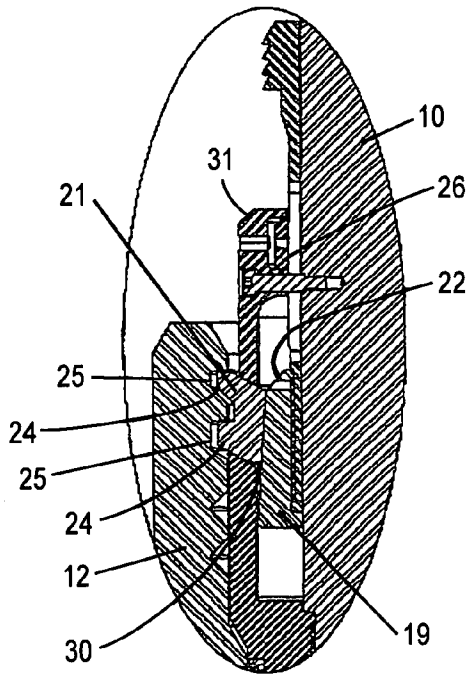
FIG. 4 is a diagram showing the position of components during actuation.

Operation of the tensioning arrangement will now be described with reference to FIGS. 3 to 5. FIG. 3 shows the arrangement before actuation, FIG. 4 shows an intermediate position during actuation and FIG. 5 shows a final position after actuation.

The initial (untensioned) position of the components is shown in FIG. 3. To apply pre-tension, an upward pull is exerted on the activation sleeve 17. This brings the chamfered upper end 22 of the load ring 19 into contact with the chamfered lower ends 23 of the ring 21, and drives the components of the ring 21 outward. The teeth 24 then engage with the inwardly facing grooves 25 of the housing 12 (as shown in FIG. 4).

Figure 5:
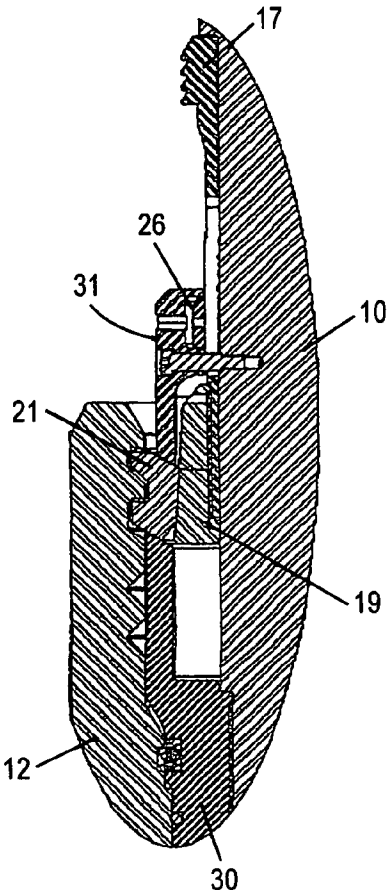
FIG. 5 is a diagram showing the components fully activated.

Movement of the sleeve 17 (as shown in FIG. 5) brings into operation the combined mechanical advantages of the two conical engagement regions i.e. one between the load ring and the split ring and another between the teeth and the grooved housing, as well as the inclined movement of the ring 21.

The actuating sleeve 19 may carry a latch ring 26 which can engage an aperture 27 in the upper sleeve 30 to hold the sleeve 19 and thereby the load ring in the final position, as a back-up to the frictional locking effecting between the outer surface of the load ring 19 and the ring 21.

The combined effect of the engagement zones and the inclination if any of the path of ring 21 should be such as to provide a mechanical advantage of at least twenty-five and preferably substantially greater.

The invention claimed is:

1. A pre-tensioning arrangement for inner and outer elongate concentric members, said arrangement comprising:

a load member which is axially moveable by being pulled in an actuating direction relative to the inner member and has an outer surface which tapers in said actuating direction, a laterally expansible ring which is engaged by said load member in an inclined engagement zone during said actuating movement, and an engagement zone between the laterally expansible ring and the outer member, said engagement zones providing a mechanical advantage between the movement of the load member and movement of the outer member wherein the load member is a ring around the inner member, the laterally expansible ring is a split or segmented ring and the load ring and the laterally expansible ring have mutually engageable chamfered edges.

2. An arrangement as in claim 4 wherein the laterally expansible member is disposed in a holder which provides an inclined path of movement for the laterally expansible member whereby outward movement of the laterally expansible member has a component in the said actuating direction.

3. A pre-tensioning arrangement for inner and outer elongate concentric members, said arrangement comprising:

a load member which is axially moveable by being pulled in an actuating direction relative to the inner member and has an outer surface which tapers in said actuating direction, a laterally expansible ring which is engaged by said load member in an inclined engagement zone during said actuating movement, and an engagement zone between the laterally expansible ring and the outer member, said engagement zones providing a mechanical advantage between the movement of the load member and movement of the outer member wherein said laterally expansible member carries teeth for engagement in grooves in the outer member.

4. A pre-tensioning arrangement for inner and outer elongate concentric members, said arrangement comprising:

a load member which is axially moveable by being pulled in an actuating direction relative to the inner member and has an outer surface which tapers in said actuating direction, a laterally expansible ring which is engaged by said load member in an inclined engagement zone during said actuating movement, and an engagement zone between the laterally expansible ring and the outer member, said engagement zone providing a mechanical advantage between the movement of the load member and movement of the outer member wherein the engagement zone between the laterally expansible member and the outer member has a shallow inclination relative to an outward direction of movement of the laterally expansible member.

5. An arrangement as in claim 4 wherein the laterally expansible ring is a split or segmented ring.

6. An arrangement as in claim 4 wherein a latch is disposed to hold the load member at an extreme limit of the actuating movement.

7. An arrangement as in claim 4 and including a reaction member between the inner and outer members.

* * * * *